US006971187B1

(12) United States Patent
Pikal et al.

(10) Patent No.: US 6,971,187 B1
(45) Date of Patent: Dec. 6, 2005

(54) AUTOMATED PROCESS CONTROL USING MANOMETRIC TEMPERATURE MEASUREMENT

(75) Inventors: Michael J. Pikal, Mansfield Center, CT (US); Xiaolin Tang, Paoli, PA (US); Steven L. Nail, West Lafayette, IN (US)

(73) Assignees: University of Connecticut, Farmington, CT (US); Purdue Research Foundation, West Lafayette, IN (US)

( * ) Notice: Subject to any disclaimer, the term of this patent is extended or adjusted under 35 U.S.C. 154(b) by 279 days.

(21) Appl. No.: 10/620,931

(22) Filed: Jul. 16, 2003

Related U.S. Application Data

(60) Provisional application No. 60/396,778, filed on Jul. 18, 2002.

(51) Int. Cl.[7] ..... F26B 5/06
(52) U.S. Cl. ..... 34/285; 34/92
(58) Field of Search ..... 34/285, 290, 292, 34/92; 436/174, 177; 62/434

(56) References Cited

U.S. PATENT DOCUMENTS 3,192,643 A * 7/1965 Rieutord ..... 34/565
4,547,977 A * 10/1985 Tenedini et al. ..... 34/538
6,176,121 B1 1/2001 Oetjen ..... 73/73
6,226,887 B1 * 5/2001 Tenedini et al. ..... 34/287
6,643,950 B2 * 11/2003 Lambert et al. ..... 34/286
2003/0116027 A1 * 6/2003 Brulls ..... 99/279

* cited by examiner

*Primary Examiner*—Stephen Gravini
(74) *Attorney, Agent, or Firm*—Alix, Yale & Ristas, LLP

(57) ABSTRACT

A method by which a freeze-drying process may be developed from a single freeze-drying experiment. The method uses in-process manometric temperature measurement (MTM) data to optimize the primary drying conditions. Manometric temperature measurement is a procedure by which the product temperature at the sublimation interface and the resistance of the previously dried product to vapor flow may be determined. The inventive method can be used in an inventive freeze-drying system. The system comprises a freeze-dryer, a measurement system including hardware and software necessary for generation of MTM data and a control system including hardware and software for interpretation of the generated MTM data and control of the freeze-dryer. The measurement system and control system may be combined into a single device. The inventive freeze-drying system utilizes a microprocessor and software to define conditions for the freezing and secondary drying stages and to define chamber pressure and "target product temperature" for the primary drying stage based on MTM data and operator input data, thereby providing a near optimized freeze-drying process.

16 Claims, 4 Drawing Sheets

AUTOMATED PROCESS CONTROL USING MANOMETRIC TEMPERATURE MEASUREMENT

This application is the non-provisional of, and claims priority from, U.S. Provisional Application No. 60/396,778, filed Jul. 18, 2002, the contents of which are incorporated herein by reference in their entirety.

STATEMENT REGARDING FEDERALLY SPONSORED RESEARCH OR DEVELOPMENT

This invention was made with Government support under Grant/Contract Nos. FRS 5-22436 from the National Science Foundation and FRS 6-33452 from the Center For Pharmaceutical Processing Research. The Government has certain rights in the invention.

FIELD OF THE INVENTION

This invention relates generally to freeze-drying processes. More particularly, the present invention relates to a system for optimizing control of a freeze-drying process.

BACKGROUND OF THE INVENTION

Freeze-drying, also termed "lyophilization", is a drying process employed to convert solutions of materials into solids. A typical freeze-dryer comprises a "drying chamber" containing temperature controlled shelves which is connected to a "condenser chamber". A large valve is disposed between the drying chamber and the condenser chamber. The condenser chamber houses a series of plates or coils capable of being maintained at very low temperature (i.e., less than −50° C.). One or more vacuum pumps are connected in series to the condenser chamber to achieve pressures in the range of about 0.03 to about 0.3 Torr in the entire system during operation. A commercial freeze-dryer may have 10–20 shelves with a total capacity on the order of 50,000 or more vials. A laboratory scale freeze dryer is smaller, with a consequently smaller capacity.

The freeze-drying process typically comprises three stages; the "freezing stage", the "primary drying stage" and the "secondary drying" stage. In a typical freeze-drying process, an aqueous solution or product containing, for example, a drug and various formulation aids, or "excipients", is filled into glass vials, and the vials are loaded onto temperature-controlled shelves within the drying chamber.

After loading the product vials the freezing stage is started. In the freezing stage most of the water in the product is converted into ice. During the freezing stage the shelf temperature is reduced, typically in several stages, to a temperature in the vicinity of −40° C., thereby converting nearly all of the water in the product into ice. Some excipients, such as buffer salts and mannitol, may partially crystallize during freezing, but most "drugs", particularly proteins, remain amorphous. The drug and excipients are typically converted into an amorphous glass containing large amounts of unfrozen water (15%–30%) dissolved in the solid (i.e., glassy) amorphous phase.

After most water and solutes have been converted into solids the primary drying stage is started. In the primary drying stage ice is removed from the product by direct sublimation. During the primary drying stage the freeze dryer is evacuated by the vacuum pumps to the desired control pressure, the shelf temperature is increased to supply energy for sublimation, and primary drying begins. Due to the large heat flow required during the primary drying stage, the product temperature runs much colder than the shelf temperature. The removal of ice crystals from the product by sublimation creates an open network of "pores" which allows pathways for escape of water vapor out of the product. The ice-vapor boundary (i.e., the boundary between frozen and "dried" regions) generally moves from the top of the product toward the bottom of the vial as primary drying proceeds. Primary drying is normally the longest part of the freeze-drying process. Primary drying times on the order of days are not uncommon, and in rare cases, weeks may be required due to a combination of poor formulation and sub-optimal freeze-drying process design. While some secondary drying does occur during primary drying (i.e., desorption of water from the amorphous phase occurs to a limited extent once the ice is removed from that region), the start of secondary drying is normally defined, in an operational sense, as the end of primary drying (i.e., when all ice is removed). Of course, since not all vials behave identically, some vials enter secondary drying while other vials are in the last stages of primary drying.

When the judgement is made that all vials are devoid of ice, the secondary drying stage is started. In the secondary drying stage most of the unfrozen water is removed from the material by desorption. During this stage the shelf temperature is typically increased to provide the higher product temperature required for efficient removal of unfrozen water. The final stages of secondary drying are normally carried out at shelf temperatures in the range of about 25° C. to about 50° C. over a period of up to several hours. Since the demand for heat is low in this stage, the shelf temperature and the product temperature are nearly identical.

Freeze-drying is a low temperature process. In general, a formulation can be dried to about 1% water or less without any of the product exceeding 30° C. Thus, conventional wisdom states that freeze-drying is less likely to cause thermal degradation than a "high temperature" drying process, such as spray drying. Historically, freeze-drying is the method of choice for pharmaceutical products intended for parenteral administration. Sterility and relative freedom from particulates are critical quality attributes for parenterals. Largely because the solution is sterile filtered immediately before filling into the final container, and further processing is relatively free of exposure to humans, a freeze-drying process maintains sterility and "particle free" characteristics of the product much easier than processes that must deal with dry powder handling issues, such as dry powder filling of a spray dried or bulk crystallized powder. Indeed, with modern robotic loading systems, humans can be removed from the sterile processing area entirely. Furthermore, since the vials are sealed in the freeze-dryer, moisture and headspace gas can easily be controlled, an important advantage for products whose storage stability is adversely affected by residual moisture and/or oxygen. Since the critical heat and mass transfer characteristics for freeze-drying are nearly the same at the laboratory scale as in full production, resolution of scale-up problems tends to be easier for a freeze-drying process than for spray drying.

Since freeze-drying equipment is very expensive and process times are often long, a freeze-dried product is relatively expensive to produce. Optimization of the entire freeze-drying process is critical to process efficiency, particularly during primary drying (normally the longest stage of the process). Too low a product temperature yields an inefficient process, and too high a product temperature will cause loss of product quality. Optimization of the freeze-drying process is also critical for freeze-dried product quality. Poor process control can lead to "product cake collapse" during primary drying and control of residual moisture is nearly always critical for storage stability. Even with a well designed formulation, a poorly designed process may require more than a week to produce material of only sub-optimal quality.

Development of optimum process conditions requires that the product temperature be maintained as high as possible during primary drying. Thus, measurement of product temperature is of paramount importance in the development of freeze-drying process conditions and in process monitoring. Presently within the pharmaceutical industry, thermocouples or resistance temperature detectors (RTDs) are placed in several product vials as a method of monitoring the entire product batch, which usually consists of thousands of vials. However, these monitored vials are not representative of the entire batch because of the tendency of the temperature measuring probe to act as a site for heterogeneous nucleation of ice. As a result, the monitored vials supercool less during freezing, freeze slower, have a larger average pore size in the "dried" layer with a correspondingly lower resistance to mass transfer, and dry faster as compared to the non-monitored vials. In addition, insertion of temperature measuring probes into product vials is a manual process that adds labor, may compromise product sterility and is incompatible with the current trend in aseptic processing to minimize operator intervention by using automatic loading and unloading systems.

Typically, freeze-drying process development is conducted by "trial and error" in laboratory scale freeze drying equipment. Due to time constraints on the development process and lack of expertise of development personnel, the resulting freeze-drying processes are often far from optimum. Further, the freeze drying process developed over the many trial and error experiments must subsequently be adapted or "scaled up" to the larger equipment and product capacities of commercial freeze drying equipment. Thus, there is a need for a method of relatively quickly optimizing a process for freeze-drying a product.

SUMMARY OF THE INVENTION

Briefly stated, one aspect of the invention is a method by which a near optimum freeze-drying process may be developed from a single freeze-drying experiment. The method uses in-process manometric temperature measurement (MTM) data and a control system to optimize the primary drying conditions. Manometric temperature measurement is a procedure by which the product temperature at the sublimation interface and the resistance of the previously dried product to vapor flow may be determined.

Briefly, in manometric temperature measurement a valve separating the drying chamber (and product) from the condenser chamber is quickly closed for a short time (for example, about 15 seconds). Pressure in the drying chamber is measured at intervals over the time that the valve is closed. The principle of manometric temperature measurement is based on the flow of water vapor from the product chamber to the condenser being momentarily interrupted during primary drying. During this perturbation of the drying process, the drying chamber pressure will rapidly increase due to the continued sublimation of ice. Since the composition of the vapor phase in the drying chamber is nearly all water vapor, sublimation will stop when the chamber pressure reaches the vapor pressure of ice at the sublimation interface, assuming that the ice temperature remains constant during the measurement. Measurement of this vapor pressure allows calculation of the product temperature at the sublimation front and resistance of the previously dried product to vapor flow at any time during primary drying.

A further aspect of the invention is an inventive freeze-drying system. The inventive system comprises a freeze-dryer, a measurement system including hardware and software necessary for generation of MTM data and a control system including hardware and software for interpretation of the generated MTM data and control of the freeze-dryer. The measurement system and control system may be combined into a single device. The inventive freeze-drying system utilizes a microprocessor and software to define conditions for the freezing and secondary drying stages and to define chamber pressure and "target product temperature" for the primary drying stage based on MTM data and operator input data, thereby providing a near optimized freeze-drying process.

A brief overview of one aspect of the inventive method and system is as follows:

Experimental Run

I Start:

An operator will load a sample number of containers filled with a volume of product onto shelves within the inventive freeze-dryer. The fill volume and containers used are representative of those intended for use in manufacturing. There is a preferred minimum amount of product that should be used. The operator will also input data into the calculations. The data may be input into a controller.

II Freezing Stage:

The product is substantially frozen in steps during the freezing stage.

III to IV Primary Drying Stage:

The drying chamber is evacuated and the product temperature is raised during the primary drying stage. The target product temperature is evaluated. The optimum chamber pressure is evaluated from the target product temperature. The initial shelf temperature for the primary drying stage is estimated based upon the product information provided by the user (primarily the collapse temperature and the solute concentration). Once in the primary drying stage, MTM data is used to evaluate the shelf temperature required to maintain the product at the target product temperature. The evaluation and estimation may be done by the controller.

V Secondary Drying Stage:

Based upon the input product information, the shelf temperature:time profile is fixed for the secondary drying stage.

The control system can monitor and save the parameters developed during the experimental run. In this embodiment, at the end of the single experiment the control system has developed and saved a near optimized freeze-drying process for the product material and conditions of that experiment. The near optimized freeze-drying process can be scaled up and used for freeze drying production quantities of the same product material.

In general, the invention may alternately comprise, consist of, or consist essentially of, any appropriate components herein disclosed. The invention may additionally, or alternatively, be formulated so as to be devoid, or substantially free, of any components, materials, ingredients, adjuvants or species used in the prior art compositions or that are otherwise not necessary to the achievement of the function and/or objectives of the present invention.

BRIEF DESCRIPTION OF THE DRAWINGS

Other objects and advantages of the invention will be evident to one of ordinary skill in the art from the following detailed description may with reference to the accompanying drawings, in which.

DETAILED DESCRIPTION OF THE INVENTION

Figure 1:
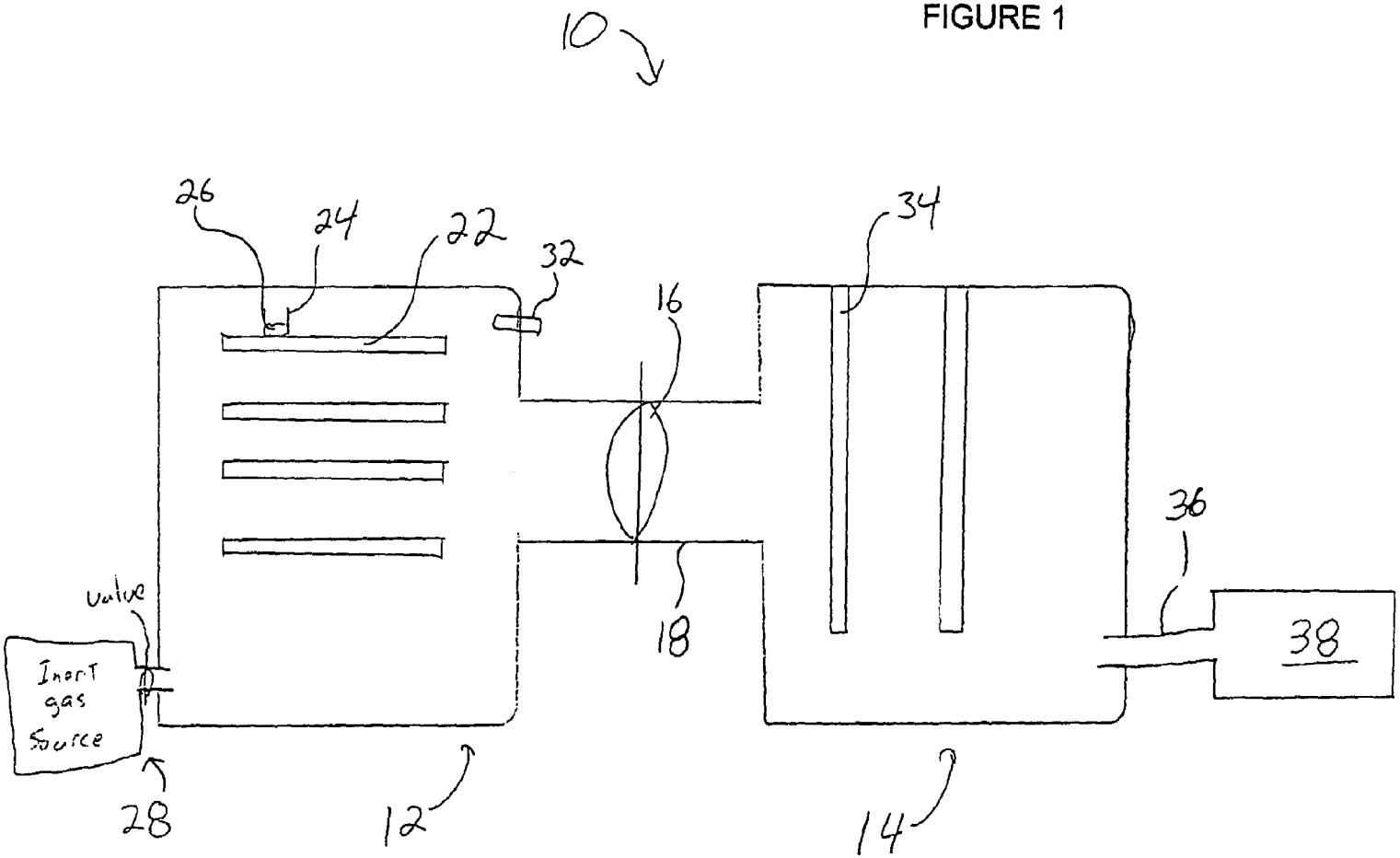
FIG. 1 is a schematic illustration of a portion of a freeze-dryer.

With reference to the drawings, wherein like numerals designate like components throughout the Figures, an inventive freeze-dryer, a portion of which is shown schematically in FIG. 1, is generally designated 10. The freeze-dryer 10 typically comprises a drying chamber 12 connected to a condenser chamber 14. A chamber valve 16 is disposed within the connection 18 to pneumatically isolate the drying chamber 12 from the condenser chamber 14 when closed.

The drying chamber 12 includes at least one shelf (each 22). The temperature of the shelf 22 can be controlled in well known fashion by, for example, circulating fluid of a desired temperature therethrough. Containers 24, such as vials, containing product 26, are placed on the shelf 22. The drying chamber 12 includes means 28 for controlled admission of an inert gas, used to control the drying chamber 12 pressure and therefore to control heat transfer from the shelf to the product and mass transfer within the product and within the freeze dryer from the vial interior to the condenser.

The drying chamber 12 is provided with a differential capacitance manometer pressure sensor 32. The differential capacitance manometer pressure sensor 32 is preferred over other types of pressure sensors as it allows measurement of pressure in the drying chamber 12 independent of the gas composition in the drying chamber 12. The differential capacitance manometer pressure sensor 32 also beneficially provides better accuracy and precision than other pressure measurement devices. A Baratron sensor available from MKS Instruments of Six Shattuck Road, Andover, Mass. 01810 has been found suitable for use in the invention.

The condenser chamber 14 includes cooling coils or plates 34. Typically the temperature of the cooling coil 34 is maintained at a temperature low enough to condense any water removed from the drying chamber 12 and to insure that the vapor pressure of ice at the condenser is small compared to the chamber pressure. The condenser chamber 14 includes a connection 36 to a vacuum source means 38. The vacuum source means 38 typically provides a lowered pressure of about 0.03 to about 0.3 Torr in the drying chamber 12.

Figure 2:
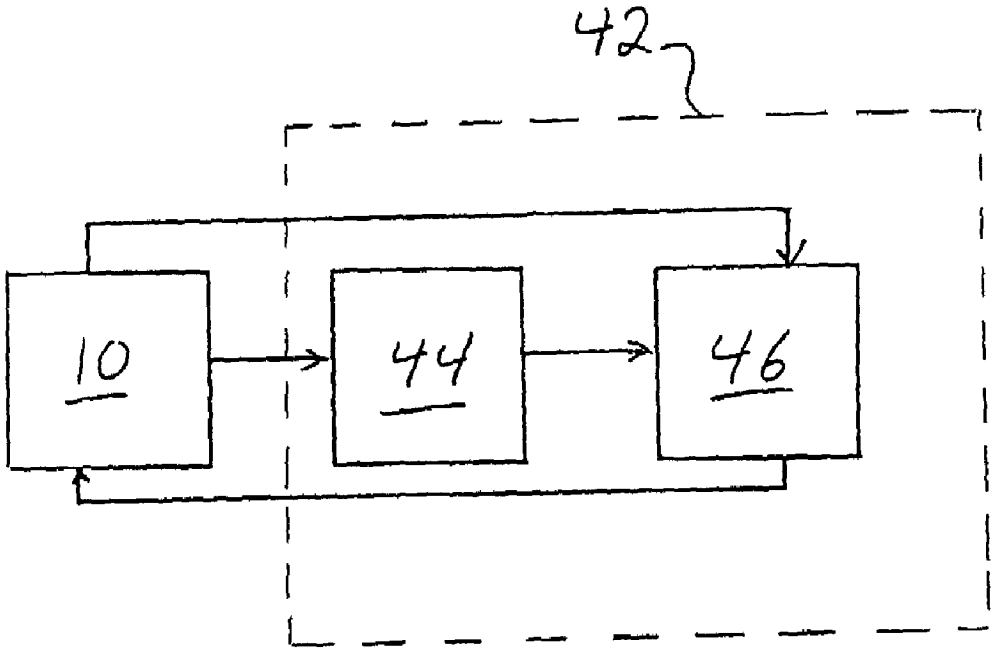
FIG. 2 is schematic illustration of one embodiment of an inventive freeze-drying system.
Figure 3:
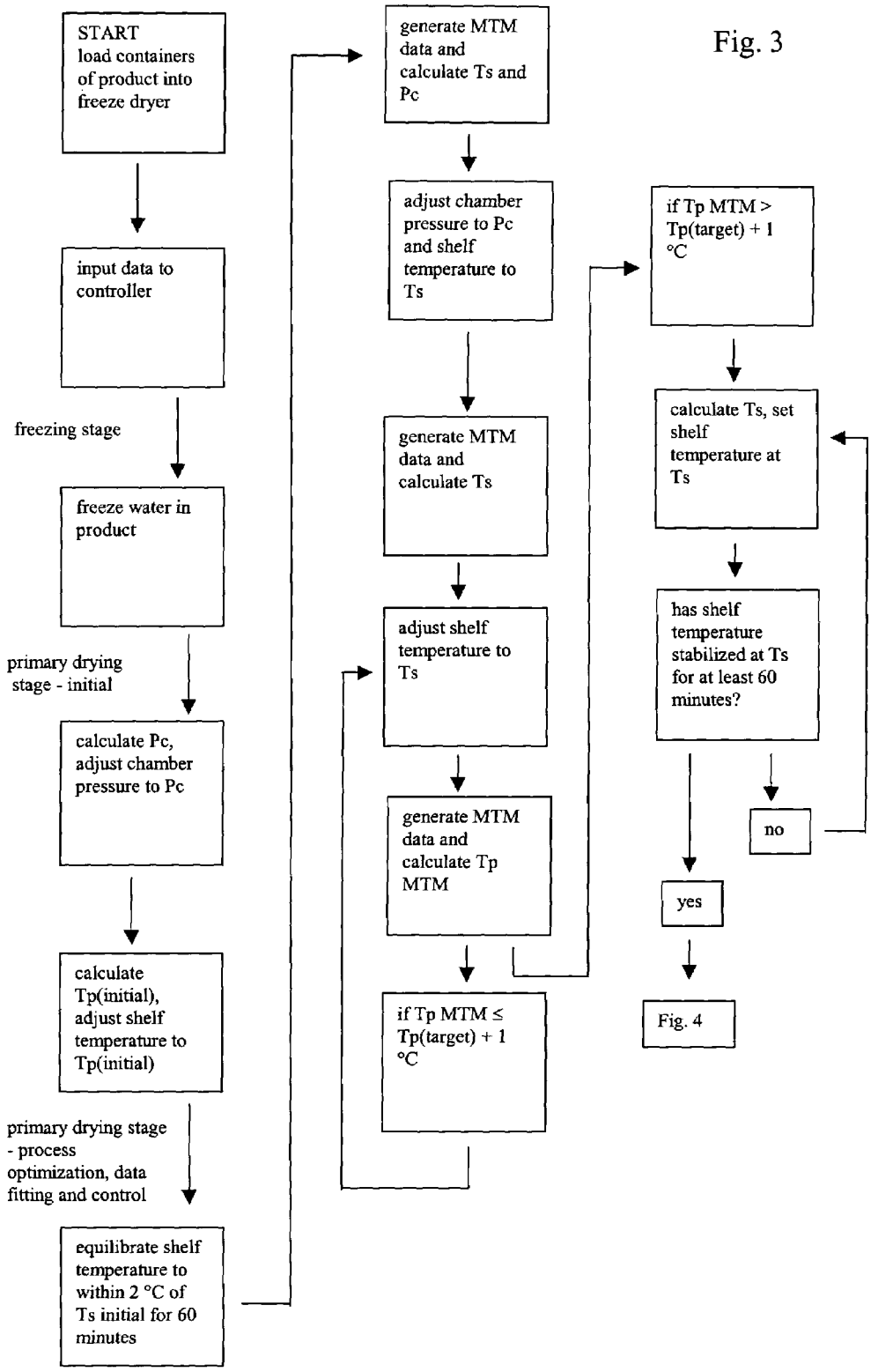
FIGS. 3 and 4 are a block representation of one embodiment of the inventive process.
Figure 4:
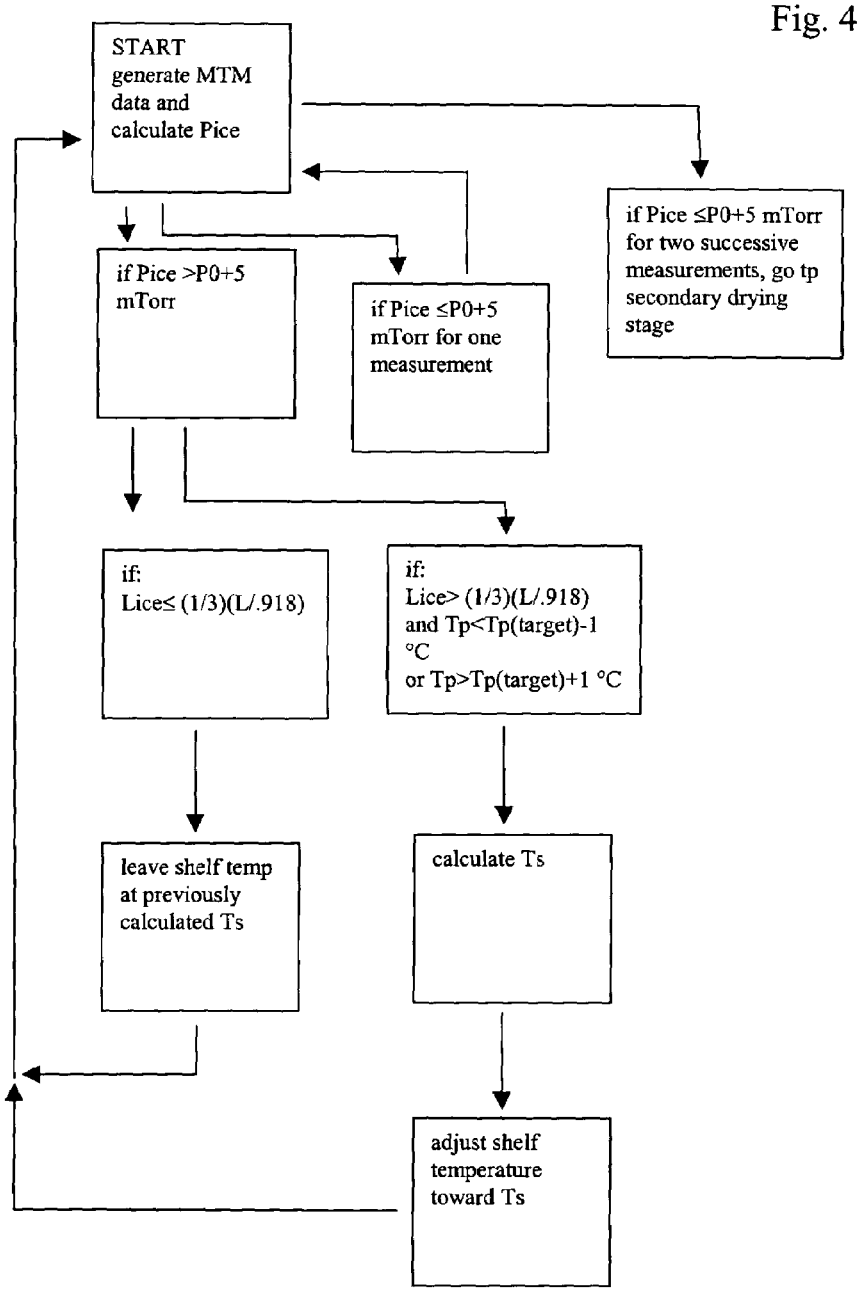

As shown in FIG. 2 the freeze-dryer 10 includes a controller 42. The controller 42 comprises a measurement system 44 and a control system 46. The control system 46 is preferably microprocessor based. The controller 42 provides monitoring and control of, for example, the inert gas inflow, shelf temperature, chamber valve position, condenser plate temperature and pressure within the drying chamber.

The controller 42, through interconnection with the differential capacitance manometer pressure sensor 32 can generate signals representative of the drying chamber 12 pressure. Manometric temperature measurement "MTM" data may be generated by closing the chamber valve 16 to isolate the drying chamber 12 from the condenser chamber 14 for a short time period, for example fifteen seconds. Pressure within the drying chamber 12 is measured at intervals of, for example four times per second. The generated pressure:time MTM data is evaluated by the controller 42 to provide product temperature data. The MTM and product temperature data are stored by the controller 42.

In one aspect of the invention, the inventive freeze-drying system 10 defines conditions for the freezing stage and the secondary drying stage and defines the drying chamber 12 pressure and the "target product temperature" for the primary drying stage based on MTM data and operator input data. The inventive freeze-drying system 10 and process can thereby provide a near optimized freeze-drying process. If desired, the near optimized freeze-drying process can be scaled up and used for freeze drying larger production quantities of the same product material.

Experimental Run

I Start:

An operator will load a sample amount of containers containing product onto shelves within the inventive freeze-dryer. The container fill volume and container type are representative of those intended for use in full scale freeze-drying. The operator will also record data that may be input into the controller.

II Freezing Stage:

The product is substantially frozen in steps during the freezing stage.

III Primary Drying Stage—Initial:

Pressure within the drying chamber 12 is lowered and the product temperature is raised during the primary drying stage. Given the previously recorded collapse temperature, $T_c$, or the input glass transition temperature of the freeze concentrate, $T_g'$, or in cases where the solute(s) are essentially 100% crystalline, the eutectic temperature, Teu, a atrget product temperature can be generated. Advantageously, the controller 42 will generate the target product temperature. The target product temperature is preferably a "safe margin" below the critical temperature, $T_c$ or $T_g'$ (or Teu, if eutectic temperature is controlling). The safety margin is chosen to be small (i.e., 2° C.) if primary drying is estimated to be long and larger if primary drying is estimated to be short.

The optimum chamber pressure is calculated from the target product temperature. The optimum chamber pressure is preferably small compared to the vapor pressure of ice at the target product temperature but should be high enough to provide uniform heat transfer to all product containers.

The initial shelf temperature for the primary drying stage is estimated based upon the product information provided by the user (primarily the solute(s) concentration and type(s)). A constraint on total heat flow can preferably be imposed to avoid overload of the freeze-dryer.

IV Primary Drying Stage—Data Fitting and Control:

Once in the primary drying stage, MTM data is used to generate initial values of product temperature and mass transfer resistance of the dried product. Dry product resistance means the resistance to flow of water vapor imposed by the dry product layer. These generated values of product temperature and resistance are used to calculate the shelf 22 temperature that will provide the desired target product temperature. Advantageously, the controller 42 generates these initial values and calculates the shelf temperature.

Early in the optimization process the steady state approximation is only a rough approximation. Consequently, the shelf 22 temperature change is limited to prevent temperature "overshoot" of the shelf 22. The controller 42 advantageously limits the shelf temperature. It is also possible for inaccurate values for the resistance of the previously dried product to vapor flow to be obtained under some circumstances, which may impact the estimated shelf temperatures. The controller 42 can minimize these problems. MTM data are accumulated periodically (i.e., about every hour), and provided that the total time in primary drying does not exceed a fraction (i.e. ⅔) of the estimated total drying time, the shelf 22 temperature is adjusted for most products when the MTM temperature deviates by more than a given tolerance (i.e., about 1° C.) from the target temperature. With substantially amorphous products at unusually high solids content per vial (i.e., typically more than 25%), water vapor re-sorption during the MTM measurement compromises the accuracy of the MTM temperature measurement once a substantial portion of the product has been dried. Here, it is preferable to use the product temperature measured by thermocouples for comparison with the target product temperature in the control process described above.

V Secondary Drying Stage:

Based upon a direct experimental determination of residual moisture content at the end of primary drying, using a sample extractor or "thief" to extract samples for Karl Fischer moisture assay, and the observed rate of pressure rise during the MTM measurement procedures, the residual moisture of the product is evaluated in real time during the process. Based upon the nature of the product, the residual moisture specification, and the "real time" residual moisture levels, the shelf 22 temperature:time profile is adjusted to expediently reach the desired level of moisture in the product. Advantageously, the controller 42 adjusts the shelf temperature:time profile.

The parameters (i.e., the chamber pressure and shelf temperature set point vs. time profile) developed during the experimental run are monitored and recorded. Advantageously, the controller 42 monitors and saves these parameters so that at the end of the single experimental run, the control system 46 has developed and saved a near optimized freeze-drying process for the sample product material and conditions. The recorded or saved freeze drying process can be repeated with the same product quantities. Alternatively, the recorded or saved freeze-drying process can be scaled up and used for freeze drying larger production quantities of the same product material. As is known in the art, scale up of the recorded or saved freeze-drying process may entail minor modification of the saved process.

The following examples are given for purposes of illustration only in order that the present invention may be more fully understood. These examples are not intended to limit in any way the scope of the invention unless otherwise specifically indicated.

Exemplary Experimental Freeze-Drying Process

I Start step 1) load containers filled with product into freeze dryer.

step 2) Input or record data for MTM:

N: Number of vials

Ap: Inner area of vials ($cm^2$)

L: Fill depth (cm)

W: Fill weight (g)

V: Effective chamber volume (liter)

step 3) Input or record data for Smart Freeze Dryer or "SMFD":

Tc: Collapse temperature (obtained from freeze drying microscopy determination of collapse or glass transition temperature (Tg') or eutectic temperature (Teu)) (° C.)

C: Concentration of solution (g/g)

step 4) Input or record data for SMFD (optional):

Nature of Drug Product (protein or stable small molecule)

Physical Form of Drug Product (amorphous or crystalline)

Type of Bulking Agent (none, crystalline, or amorphous)

ρ: Density of the solute (default 1.5): ($g/cm^3$)

Type of vials ("molded" or "tubing")

$Q_{of}$: Overload Heat flow of the freeze-dryer (default $3\times10^5$) (cal/hr)

II Freezing Stage:

For formulation with crystalline products and/or crystalline bulking agents.

step 1) cool shelf e.g. set the shelf temperature:time program to change the shelf temperature set point to the prescribed program. 1° C./min to 5° C., hold for 30 min;

step 2) cool shelf 1° C./min to −5° C., hold for 30 min;

step 3) cool shelf 1° C./min to −30° C.;

step 4) heat shelf 1° C./min to −22° C., hold for 180 min;

step 5) cool shelf 1° C./min to the lower temperature of Tc−5° C. or −40° C.;

step 6) hold shelf temperature at the stage II, step 5 temperature for 60 min if the fill depth<1 cm; or hold shelf temperature at the stage II, step 5 temperature for 120 min if the fill depth>1 cm.

step 7) go to III Primary drying stage—initial.

For formulation without crystalline products or bulking agents (amorphous only).

step 1) Cool shelf 1° C./min to 5° C., hold for 30 min;

step 2) cool shelf 1° C./min to −5° C., hold for 30 min;

step 3) cool shelf 1° C./min to the lower temperature of Tg'−5° C. or −40° C.;

step 4) hold temperature of shelf at the stage II, step 3 temperature for 60 min if the fill depth<1 cm; or hold temperature of shelf at the stage II, step 3 temperature for 120 min if the fill depth>1 cm.

step 5) go to III Primary drying stage—initial.

III Primary Drying Stage—Initial: Determination of Initial Shelf Temperature, Ts Initial.

Option 1 (Preferred)

step 1) Calculate the drying chamber pressure (Pc) by equation 1;

step 2) Set the pressure of the drying chamber to the value of Pc calculated in stage III, step 1;

step 3) calculate estimated initial product temperature Tp(initial) by equation 1.2;

step 4) Set the temperature of the shelf to Tp(initial) calculated in stage III, step 3;

step 5) Go to Section IV. Primary drying stage—Process Optimization, data fitting, and control:

Option 2 (Alternative)

step 1) Calculate the chamber pressure (Pc) by equation 1;

step 2) Set the pressure of the drying chamber to Pc calculated immediately above in stage III (Option 2), step 1;

step 3) Calculate heat transfer coefficient (Kv) by equation 12;

step 4) Calculate ice vapor pressure ($P_{ice}$) by equation 14;

step 5) Assign value to Rp,

If concentration of solution C≦1%, then Rp=2,

If concentration of solution 1%<C<10%, then Rp=4,

If concentration of solution C≧10%, then Rp=6, step 6) Calculate total heat flow (dQ/dt total) by equation 16, If dQ/dt (total)>$Q_{of}$, then dQ/dt (total)=$Q_{of}$;

step 7) Calculate dm/dt by equation 17;

step 8) Calculate Ts(initial) by equation 13;

step 9) Adjust the temperature of the shelf to Ts(initial) calculated immediately above in stage III, step 8 at 0.5° C./min;

step 10) Collect MTM data every 15 min;

step 11) Assign ice thickness: L'=L/0.918, where L is the liquid fill depth;

step 12) Fit the pressure vs. time data generated from MTM measurement data generated in step 10 to equation 2 (to yield Pice and Rp);

step 13) Calculate Tp MTM by equation 3,

If Tp MTM>Tp(initial), then decrease shelf temperature 5° C. at the maximum cooling rate. This new shelf temperature then becomes Ts(initial). The initial target product temperature, Tp (initial), is Tc—a safety margin. The safety margin is initially 3° C. The safety margin is re-calculated once the first MTM measurement is made and the target product temperature, Tp, is re-evaluated. Go to Primary drying stage—Process Optimization, data fitting, and control IV Primary Drying Stage—Process Optimization, Data Fitting, and Control:

After the shelf temperature has equilibrated to within 2° C. of Ts initial for 60 min, then re-start the MTM procedure (i.e., close the valve and take pressure vs. time reading at predetermined intervals, normally every ½ hr or every hour).

Procedure for Calculating (Final) Target Product Temperature and Associated Quantities (MTM Pressure vs. Time):

step 1) Assign ice thickness as L'=L/0.918, where L is the liquid fill depth;

step 2) Fit MTM data to equation 2 (to yield Pice and Rp);

step 3) Calculate Tp MTM by equation 3;

step 4) Calculate mass flow (dm/dt) by equation 4;

step 5) Calculate nominal heat flow $(dQ/dt)_{MTA-1}$ by equation 5,

If $(dQ/dt)_{MTA-1} \geqq Q_{of}$, then $(dQ/dt)_{MTA-1}=Q_{of}$, else $(dQ/dt)_{MTA-1}$ is the value calculated from equation 5;

step 6) Calculate product temperature $Tp_{overflow}$ by equation 15;

step 7) Calculate the primary drying time, $t_{primary}$ by equation 6;

step 8) Estimate Tp(target) product temperature, if $t_{primary}$<6 hr; use 5° C. safety margin (Tp(target) =Tc−5° C.), if $t_{primary}$>48 hr; use 2° C. safety margin (Tp(target) =Tc−2° C.), else use 3° C. safety margin (Tp(target)=Tc−3° C.), if Tp(target)>=$Tp_{overflow}$, then Tp(target)=$Tp_{overflow}$;

step 9) Calculate shelf temperature (Ts) using Method 1:

Method 1:

Calculate temperature of bottom ice (Tb) by equation 10;

Calculate heat transfer coefficient of vials (Kv) by equation 11;

Calculate shelf temperature (Ts) by equation 7; set the shelf temperature to calculated Ts value.

step 10) Re-calculate chamber pressure (Pc) by equation 1 using target product temperature as evaluated above using the safety margin selected based upon the primary drying time;

step 11) Adjust the chamber pressure to Pc calculated in stage IV, step 10;

step 12) Collect MTM pressure vs. time data. (e.g. collect the pressure data at the predetermined time intervals after the valve is closed);

step 13) Fit the MTM data to equation 2 (to yield Pice and Rp);

step 14) Calculate Tp MTM by equation 3;

step 15) Calculate nominal heat flow by equation 5;

step 16) Calculate ice thickness using Method 2:

Method 2

Calculate mass flow by equation 4;

Calculated total weight of ice sublimed ($W_{sublimation}$) by equation 8;

Calculate ice thickness ($L_{ice}$) by equation 9;

step 17) Calculate shelf temperature (Ts) using Method 1;

Method 1:

Calculate temperature of bottom ice (Tb) by equation 10;

Calculate heat transfer coefficient of vials (Kv) by equation 11;

Calculate shelf temperature (Ts) by equation 7;

step 18) Adjust the shelf temperature to Ts calculated in stage IV, step 17 at 1° C./min.

step 19) Collect MTM pressure vs. time data every 15 minutes, and fit the MTM data to equation 2 (to yield Pice and Rp);

step 20) Calculate Tp MTM by equation 3:

If Tp MTM>Tp(target)+1° C., than calculate Ts by equation 7 and adjust the shelf temperature to this calculated Ts (stage IV, step 20), else leave the shelf temperature at Ts calculated in stage IV, step 17;

step 21) After the shelf temperature stabilizes at the Ts chosen in stage IV, step 20 for 1 hour or longer, go to stage IV, step 22:

step 22) Collect MTM data every 60 min;

step 23) Fit the MTM data generated in stage IV, step 22 to equation 2 (to yield Pice and Rp);

step 24) If Pice>P0+5 mTorr, go to Method 4,

Method 4, a) Calculate Tp MTM by equation 3;

b) Calculate nominal heat flow by equation 5;

c) Calculate ice thickness by using Method 3,

Method 3, a) Calculate mass flow by equation 4, b) Calculate total weight of ice sublimation ($W_{sublimation}$) by equation 8, c) Calculate ice thickness ($L_{ice}$) by equation 9, If Lice>(⅓)*(L/0.918) and Tp<Tp(target)−1° C. or Tp>Tp(target)+1° C., then calculate Ts by Method 1 as described in Section IV, step 17, and adjust the shelf temperature to this value of Ts. (Here, Tp means Tp MTM or product temperature evaluated experimentally by temperature sensors (i.e., thermocouples) placed directly in several vials, whichever method of temperature measurement is being employed. If $L_{ice} \leqq$(⅓)*(L/0.918) leave the shelf temperature at Ts previously calculated in stage IV, step 17; (note: if the ice remaining is so small as to meet this criterion, primary drying is almost over, and the shelf temperature is left where it was until primary drying is fully over).

Note: Tp is used to denote the actual product temperature, normally measured by MTM, except for those cases where MTM does not give good data, as explained above. Tp(target) is used to denote the calculated desired product temperature.

If Pice≦P0+5 mTorr for one MTM measurements, go to stage IV, step 22;

If Pice≦P0+5 mTorr for two successive MTM measurements, proceed to Secondary Drying stage.

V Secondary Drying Stage: Operator Selects either Method 1 or Method 2 (Default is Method 1).

Method 1: Fixed Time Operation

For formulation with crystalline products and/or crystalline bulking agents step 1) adjust shelf temperature to 40° C. at 0.3° C./min; hold for 60 minutes.

step 2) adjust shelf temperature to 50° C. at 0.3° C./min.

step 3) maintain shelf temperature at 50° C. for 180 min; Cool to 25° C. at 2° C./min, and terminate the experiment when convenient.

For non-crystalline formulations:

step 1) adjust shelf temperature to 40° C. at 0.1° C./min;

step 2) maintain the shelf temperature at 40° C. for 240 min (if the concentration of formulation ≦5% w/w); or step 3) maintain the shelf temperature at 40° C. for 360 min (if the concentration of formulation >5% w/w).

step 4) Cool to 25° C. at 2° C./min, and terminate the experiment when convenient.

Method 2 step 1) Using a sample extractor, or other suitable method, remove several vials and determine the residual moisture content by a suitable technique, such as Coulometric Karl Fischer titration.

step 2) Close the valve separating the drying chamber from the condenser chamber, as in the MTM procedure described earlier, and accumulate the pressure vs. time data by this "pressure rise experiment".

step 3) Calculate the weight percent residual moisture using equations 18, 19, and 20.

step 4) adjust shelf temperature to 40° C.; hold for 60 minutes step 5) Repeat Steps 2–4 (Section V, Method 2) at hourly intervals until either: (a) the calculated residual moisture is less than or equal to the target residual moisture. If the target residual moisture is not specified in the input data, the target will be taken as 0.5%, or (b) the total time elapsed since the beginning of this step exceeds 4 hours. If (a) is true, go to Step 7 below; If (b) is true, go to Step 6 below.

step 6) adjust shelf temperature to 50° C.; hold for 60 minutes, and then repeat Steps 1–4 at hourly intervals until either the calculated residual moisture is less than or equal to the target residual moisture or the total time elapsed in this step exceeds four hours. Then go to Step 7 immediately below.

step 7) Cool to 25° C. at 2° C./min, and terminate the experiment when convenient.

During the experimental run, in some advantageous embodiments the controller 42 can log parameters in real time at a frequency selected by the operator. At the end of the single experimental run the controller 42 has developed and saved a near optimized freeze-drying process for the particular containers and product. The saved parameters include optimized chamber pressure, target product temperature and shelf temperature vs. time profile. The parameters are typically saved as files in a storage device, for example a hard drive, on the control system 46. These parameters will define the process to be used in manufacturing, as long as scale-up adjustments are not required.

Equations equation 1—Chamber pressure:

$$Pc=0.28998*10^{(0.0191*(Tp\ initial))} \quad \text{Equation 1.1}$$

$$Tp(initial)=Tc-3°\ C. \quad \text{Equation 1.2}$$

if Tp(initial)≧−15° C., then Tp(initial)=−15° C.;

else Tp(initial)=Tc−3° C.

Parameters:

Pc: calculated optimum chamber pressure (Torr)

Tp(initial): estimated initial product temperature (° C.)

Tc: collapse temperature equation 2—MTM equation:

$$P(t)=Pice-(Pice-P0)*\exp(-((N*A*62.3*T')/(18*V*Rp*3600))*t)+0.0465*Pice*(24.7*L_{ice}*(Pice-P0)/Rp-0.0102*L_{ice}*(T'-6144.96/(24.01849-\ln(Pice))))/(1-0.0102*L_{ice})*(1-0.811*\exp(-0.114*t/L_{ice}))+EX*t;$$

Parameters:

P(t): chamber pressure as a function of time, (Torr)

Pice: vapor pressure of ice (Torr); determined by fit.

P0: vapor pressure of chamber just before valve closing (Torr)

N: # of vials to be freeze-dried

Ap: cross sectional "inner" area of vial calculated from the inner diameter ($cm^2$)

T': shelf temperature (K)

V: effective chamber volume (L)

Rp: resistance of the dried cake ($cm^2$*Torr*hour/g); determined by fit.

$L_{ice}$: ice thickness (cm)

EX: linear component of vapor pressure rising including heating of the ice and chamber leak (Torr/sec) EX is determined by fit. An initial value is input as is typical for non-linear regression procedures.

t: time (seconds)

equation 3—Fitted MTM product temperature:

$$Tp\ MTM=6144.96/(24.01849-\mathrm{LN}(Pice))-273.15$$

Parameters:

Tp MTM: product temperature (MTM) (° C.)

Pice: vapor pressure of ice (Torr)

LN: natural logarithm equation 4—Mass Flow in each vial $$dm/dt=Ap*(Pice-(P0+Pc)/2)/Rp$$

Parameters:

dm/dt: mass flow of sublimation of ice (g/vials/hr)

Ap: inner area of vials ($cm^2$)

P0: vapor pressure of chamber just before valve closing (Torr)

Pice: fitted water vapor pressure of ice at the sublimation interface (Torr)

Rp: fitted total resistance of dried product to mass transfer ($cm^2$*Torr*hr/g)

Pc: set chamber pressure (Torr)

equation 5—Moving Temperature Average—1 Method: nominal heat flow estimate $$(dQ/dt)_{MTA\text{-}1}=Ap*(\mathrm{EXP}(-6144.96/(Tp\ \ MTM+Tp(target)-1)/2+273.15)+24.01849)-Pc)*\Delta Hs/Rp$$

Parameters:

$(dQ/dt)_{MTA-1}$: heat flow at the sublimation interface by average temperature of fitted temperature of ice interface temperature minus one and target product temperature (cal/hr/vial)

Ap: inner area of vials ($cm^2$)

Tp MTM: fitted temperature of ice interface (° C.)

Tp(target): Target product temperature (° C.) (input Tc−3° C.)

ΔHs heat of sublimation of ice (cal/g).

Pc: set chamber pressure (Torr)

Rp: fitted total resistance of dried product to mass transfer ($cm^2$ Torr hr/g)

equation 6—Primary drying time estimate:

$$t_{primary}=1.4*(1-C)*W*667/((dQ/dt)_{MTA-1})$$

Parameters

C: concentration of the solution (weight fraction solids)

W: weight of solution in one vial (g)

$dQ/dt)_{MTA-1}$: heat flow at the sublimation interface by average temperature of fitted temperature of ice interface temperature minus one and target product temperature (cal/hr/vial)

equation 7 Moving Average Temperature—1 Method:

$$Ts=Tp(target)+((dQ/dt)_{MTA-1}/(Ap*1.2))*(1/(Kv*3600)+L_{ice}/20.52)$$

Parameters:

Ts: calculated shelf temperature (° C.)

Tp(target): Target product temperature (° C.)

$(dQ/dt)_{MTA-1}$: heat flow at the sublimation interface by average temperature of fitted temperature of ice interface temperature minus one (cal/hr/vial)

Ap: cross section area of vial interior ($cm^2$)

Kv: Heat transfer coefficient of vials (cal/(sec*$cm^2$*K))

$L_{ice}$: Calculated ice thickness (cm)

equation 8—Calculation of the amount of ice sublimation:

calculation for the first MTM data collection, This calculation is updated periodically throughout the time period when MTM data are being collected. $W_1$ refers to the first MTM data collection (equation 8.1), and the second and subsequent MTM data collections are treated by equation 8.2:

Formula:

$$W_1=(dm/dt)_1*t \qquad \text{Equation 8.1}$$

Parameters:

$W_1$: calculated mass loss at the first MTM data collect (g/vial)

$(dm/dt)_1$: $1^{st}$ fitted mass flow value calculated from eq. 4 (g/hr/vial)

t: time interval from the beginning of primary drying to $1^{st}$ MTM (hr)

calculation for the second and subsequent MTM data collections:

Formula:

$$W_{sublimation}=(((dm/dt)_{n-1}+(dm/dt)_n)/2)(t_n-t_{n-1})+W_{n-1} \qquad \text{Equation 8.2}$$

Parameters:

$W_{sublimation}$: accumulated mass loss (g/vial)

$(dm/dt)_{n-1}$: the (n−1)th fitted mass flow value (g/hr)

$(dm/dt)_n$: the nth fitted mass flow value (g/hr)

$t_n-t_{n-1}$: the time interval between (n−1)th and nth MTM measurement.

$W_{n-1}$: calculated mass loss at the n−1 th MTM measurement equation 9—Calculation of ice thickness (1) epsilon Formula:

$$\text{epsilon}(ep)=(S-C)/(S-0.082*C) \qquad \text{Equation 9.1}$$

Parameters:

S: density of solute (g/$cm^3$)

C: concentration of solution (g/$cm^3$)

(2) calculated thickness of ice

Formula:

$$L_{ice}=L/0.918-W_{sublimation}/(ep*Ap*0.918) \qquad \text{Equation 9.2}$$

Parameters:

$L_{ice}$: calculated ice thickness

L: fill depth (cm)

ep: epsilon

Ap: intersection area of dried cake ($cm^2$)

$W_{sublimation}$: calculated total weight of ice sublimation (g). Note that $W_{sublimation}$ (accumulated mass loss in (g/vial)) is the same as $W_{sublimation}$ (total weight of ice sublimation (g)).

equation 10—Calculated temperature of bottom ice (° C.)

Formula:

$$Tb=(dQ/dt)*L_{ice}/(Av*K_I)+Tp\ MTM; \qquad \text{Equation 10.1}$$

$$Av=1.2*Ap \qquad \text{Equation 10.2}$$

$$K_I=20.52\ \text{cal/(hr*cm}^2\text{*K)},$$

Parameters:

$K_I$: thermal conductivity of ice (cal/(hr*$cm^2$*K))

Tb: ice temperature at the vial bottom (° C.)

dQ/dt: heat flow calculated by MTM fitted values (cal/hr/vial)

$L_{ice}$: Calculated ice thickness (cm), here set Lice=fill depth (L)

Av: area of outer vial bottom ($cm^2$)

K: degrees Kelvin

Tp MTM: fitted temperature of ice interface (° C.); =Tp MTM

Ap: cross sectional "inner" area of vial calculated from the inner diameter ($cm^2$)

equation 11—Heat transfer coefficient of vials

Formula:

$$Kv=(dQ/dt)/((Ts-Tb)*Ap*1.2*3600)$$

Parameters:

Kv: Heat transfer coefficient of vials (cal/(sec*$cm^2$*K))

dQ/dt: calculated heat flow (cal/hr/vial)

Ts: set shelf temperature (° C.)

Tb: calculated temperature of bottom ice (° C.)

Ap: cross section area of dried product ($cm^2$)

equation 12—Heat transfer coefficient of given vials

Formula:

$$Kv=(10\hat{}-4)*(KC+33.7*Pc/(1+KD*Pc))$$

Parameters

Kv: heat transfer coefficient of given vials at given temperature (cal/(sec*$cm^2$*K))

KC: the sum of heat transfer coefficient from direct conduct and radiation (cal/(sec*$cm^2$*K))*$10^4$, for tubing vials KC=2.24, for molded vials KC=1.82.

KD: A constant value for each specific type of vials, for tubing vials KD =3.64, for molded vials KD=5.18.

Pc: chamber pressure in Torr.

equation 13—Initial shelf temperature

Formula:

$$Ts(initial)=Tp(initial)+0.153*(dm/dt)/(Ap*Kv)$$

Parameters

Ts(initial): initial shelf temperature (° C.)

Tp(initial) initial estimate of target product temperature, ° C.; =Tc−3

Kv: heat transfer coefficient of given vials at given temperature (cal/(sec*cm$^2$*K)) calculated from equation 12.

dm/dt: mass flow (g/hr/vial)

Ap: Inner area of vials (cm$^2$)

equation 14—Vapor pressure of ice at estimated product temperature

Formula:

$$P_{ice}=26980000000*EXP(-6144.96/(273.16+Tc-3))$$

If Tc−3° C.≧−15° C., then Tc−3° C.=−15° C.

else Tc−3° C.=Tc−3° C.

Parameters $P_{ice}$: vapor pressure of ice at estimated product temperature (Torr)

Tc: collapse temperature (° C.)

equation 15—Re-estimated product temperature at condenser overflow

Formula:

$$Tp_{overflow}=(-6144.96/(24.01849-\ln(Q_{of}*Rp/Ap/\Delta Hs+Pc))-273.15)*2+1-Tp\ MTM$$

Parameters:

$Tp_{overflow}$: product temperature at which the condenser overflow (° C.)

$Q_{of}$: maximum condenser heat flow (cal/hr)

Rp: resistance of the dried cake (cm$^2$*Torr*hour/g)

Ap: inner area of the vials (cm$^2$)

ΔHs: heat of sublimation of ice (cal/g)

Pc: chamber pressure (Torr)

Tp MTM: fitted MTM product temperature (° C.)

equation 16—Estimated Total heat flow

Formula:

$$dQ/dt(Total)=670*N*Ap*(Pice-Pc)/Rp$$

Parameters dQ/dt(Total): Total heat flow (cal/hr)

N: number of vials

Ap: interface area of product in a vial (cm$^2$)

Pice: ice vapor pressure at estimated product temperature (Torr) from equation 14.

Pc: optimum chamber pressure at estimated product temperature (Torr)

Rp: Dry layer resistance.

equation 17—Estimated initial mass flow, per vial

Formula:

$$dm/dt=dQ/dt(Total)/(670*N)$$

Parameters dQ/dt(Total): Total heat flow (cal/hr)

N: total number of vials equation 18—Calculation of Water Removal Rate in Secondary Drying Formula:

$$dw/dt=(18*V/RT)(dP/dt)$$

Parameters:

dw/dt: rate of removal of water, g/s

V: Volume of drying chamber

R: Gas constant

T: Temperature of gas in drying chamber (estimated or measured)

P: Chamber Pressure in Torr

T: time, in seconds equation 19—Calculation of Water Removed in Secondary Drying Formula:

$$\Delta w(t)=\Sigma\Delta w_i\ \Delta w_i=(dw/dt)_i*\Delta t_i$$

Parameters:

Δw(t): total loss of moisture between the time at which residual moisture is measured and the time at which the last pressure rise test is conducted (i.e., the present time, t).

$\Delta w_i$: the loss in moisture during the "$i^{th}$" time interval calculated from the rate of water removal measured for the $I^{th}$ interval, $(dm/dt)_I$, and time interval for the $i^{th}$ interval, $\Delta t_I$ Σ notation indicating a summation from the first time interval to the last time interval when the pressure rise test is conducted equation 20—Calculation of Residual Moisture Content from Pressure Rise Data Formula:

$$\%\ H_2O=100*[N*V*C*(\%\ H_2O)_{initial}*0.01-\Delta w(t)]/[N*V*C]$$

Parameters:

% $H_2O$: weight percent residual moisture in the product at time t.

N: number of vials containing product in the freeze dryer

V: fill volume (cm$^3$) per vial

C: concentration of solids in fill solution, g/cm$^3$ $(\%\ H2O)_{Initial}$ weight percent residual moisture in the product at the end of primary drying (start of secondary drying) as measured in Section V, Method 2, step 1.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A freeze-drying process, comprising:

providing input data representative of a container holding a portion of a product comprising water;

loading the container onto a shelf within a drying chamber of a freeze-drying apparatus;

freezing at least some of the product water;

calculating an initial product temperature based on the input data;

calculating a target chamber pressure based on the target product temperature;

beginning a primary drying stage, comprising, lowering pressure within the drying chamber to the target chamber pressure;

adjusting the shelf to the initial product temperature;

removing a majority of the frozen water by sublimation;

generating a signal based on a condition of the product;

receiving the generated signal;

calculating a target product temperature as a function of the generated signal; and adjusting the shelf to the target product temperature.

2. The method of claim 1 wherein the generated signal comprises manometric temperature measurement data.

3. The method of claim 1 comprising the steps of:

generating a plurality of signals each based on a condition of the product at a respective plurality of times during the primary drying stage;

receiving each generated signal sequentially;

calculating a plurality of target product temperatures as a function of each of the generated signals in the plurality; and adjusting the shelf toward each target product temperature in the plurality.

4. The method of claim 1 wherein the generated signal comprises pressure within the drying chamber measured at a plurality of times during the primary drying stage.

5. The method of claim 1 wherein the step of generating a signal comprises measuring pressure independent of gas composition within the drying chamber over a time period.

6. The method of claim 1 comprising the steps of:

generating a plurality of signals each based on a condition of the product at a respective plurality of times during the primary drying stage;

receiving each generated signal sequentially;

calculating a plurality of target product temperatures as a function of each of the generated signals in the plurality;

adjusting the shelf to each target product temperature in the plurality; and recording each time and respective target product temperature.

7. The method of claim 1 comprising the steps of:

generating a plurality of signals each based on a condition of the product at a respective plurality of times during the primary drying stage;

receiving each generated signal sequentially;

calculating a plurality of target product temperatures as a function of each of the generated signals in the plurality;

adjusting the shelf to each target product temperature in the plurality;

storing each time and respective target product temperature; and using the stored time and product temperature to adjust the shelf temperature of a different primary drying stage comprising a different portion of the product.

8. The method of claim 1 wherein the step of generating a signal comprises measuring pressure within the drying chamber independent of atmosphere composition within the drying chamber and over a time period and wherein the product condition comprises at least one of product temperature at the sublimation interface and resistance of previously dried product to water vapor flow.

9. The method of claim 1, wherein:

the freeze drying apparatus comprises a condenser chamber fluidly connected to the drying chamber; a valve selectively isolating the drying chamber from the condenser chamber; a differential capacitance manometer pressure sensor fluidly connected to measure pressure in the drying chamber; a vacuum source fluidly connected to the condenser chamber; means for control of the shelf temperature; and a controller operably connected to the valve, the differential capacitance manometer pressure sensor and the means for control of the shelf temperature;

the step of providing input data comprises providing input data to the controller;

the steps of calculating an initial product temperature and a target chamber pressure are performed by the controller;

the steps of lowering pressure within the drying chamber and adjusting the shelf to the initial product temperature are controlled by the controller;

the step of generating a signal comprises, sending a first valve control signal from the controller to the valve, receiving the first valve control signal and closing the valve thereby fluidly isolating the drying chamber from the condenser chamber, measuring a pressure within the isolated drying chamber using the differential capacitance manometer pressure sensor, generating a signal that is representative of the measured pressure;

sending a second valve control signal from the controller to the valve, receiving the second valve control signal and opening the valve thereby fluidly connecting the drying chamber to the condenser chamber, the step of receiving the generated signal comprises receiving the generated signal at the controller;

the step of calculating a target product temperature is performed by the controller; and the step of adjusting the shelf to the target product temperature comprises, sending a first shelf temperature control signal from the controller to the means for control of the shelf temperature, and receiving the first shelf temperature control signal and adjusting the shelf temperature toward the target product temperature as a result thereof.

10. A freeze-drying apparatus, comprising;

a drying chamber having a shelf for supporting a container holding a portion of a product;

means for admitting an inert gas within the drying chamber;

means for adjusting temperature of the shelf;

a differential capacitance manometer pressure sensor fluidly connected to measure pressure in the drying chamber and provide a signal representative of the measured pressure;

a condenser chamber fluidly connected to the drying chamber;

a vacuum source fluidly connected to the condenser chamber; and a microprocessor controller for receiving the signal, calculating a product condition as a function of the signal, generating a control signal as a function of the calculated product condition and modulating the shelf temperature and drying chamber pressure using the control signal.

11. The apparatus of claim 10 comprising digital storage means for storing the control signal.

12. The apparatus of claim 10 wherein the signal comprises pressure rise within the drying chamber over a time period and wherein the calculated product condition comprises at least one of product temperature at a sublimation interface and resistance of previously dried product to water vapor flow.

13. The apparatus of claim 10 wherein the signal comprises manometric temperature measurement data and wherein the calculated product condition comprises at least one of product temperature at a sublimation interface and resistance of previously dried product to water vapor flow.

14. A method of sublimating water from a product, comprising:

stage I:

step 1) loading at least one vial filled with a portion of a product comprising water into a freeze dryer;

step 2) recording data, including number of vials (N), inner area of vials (Ap in $cm^2$), fill depth of vials (L in cm), fill weight of vials (W in g) and effective chamber volume (V in liter);

step 3) recording data, including concentration of solution (C in g/g) and one of collapse temperature (Tc in ° C.), glass transition temperature (Tg' in ° C.) or eutectic temperature (Teu in ° C.);

step 4) going to stage II freezing;

stage II freezing:

freezing some of the water in the product using one of II a or II b:

II a, for formulation with crystalline products and/or crystalline bulking agents:

step 1) cooling the shelf at a rate of about 1° C./min to about 5° C., holding for about 30 mm;

step 2) cooling the shelf at a rate of about 1° C./min to about −5° C., holding for about 30 mm;

step 3) cooling the shelf at a rate of about 1° C./min to about −30° C.;

step 4) heating the shelf at a rate of about 1° C./min to about −22° C., holding for about 180 min;

step 5) cooling the shelf at a rate of about 1° C./min to the lower temperature of Tc−5° C. or −40° C.;

step 6) holding the shelf temperature at the stage II, step 5 temperature for 60 min if the fill depth<1 cm, or holding the shelf temperature at the stage II, step 5 temperature for 120 min if the fill depth>1 cm.

step 7) go to stage II Primary drying—initial; or

II b for formulation without crystalline products or bulking agents (amorphous only):

step 1) cooling the shelf at a rate of about 1° C./min to about 5° C., holding for about 30 mm;

step 2) cooling the shelf at a rate of about 1° C./min to about −5° C., holding for about 30 min;

step 3) cooling the shelf at a rate of about 1° C./min to the lower temperature of Tg'−5° C. or −40° C.;

step 4) holding the shelf temperature at the stage II, step 3 temperature for 60 min if the fill depth<1 cm; or holding the shelf temperature at the stage II, step 3 temperature for 120 min if the fill depth>1 cm;

step 5) going to stage III Primary drying—initial;

stage III Primary drying—initial:

determining the initial shelf temperature (Ts) using one of III a or III b:

III a step 1) calculating a drying chamber pressure (Pc) by equation 1;

step 2) setting the drying chamber pressure to the value of Pc calculated in stage III a, step 1;

step 3) calculating an estimated initial product temperature Tp(initial) by equation 1.2;

step 4) setting the shelf temperature to Tp(initial) calculated in stage III a, step 3;

step 5) going to stage IV primary drying; or

III b step 1) calculating a chamber pressure (Pc) by equation 1;

step 2) setting the chamber pressure to Pc calculated immediately above in stage III b, step 1;

step 3) calculating a heat transfer coefficient (Kv) by equation 12;

step 4) calculating an ice vapor pressure ($P_{ice}$) by equation 14;

step 5) assigning a value to Rp, wherein if concentration of solution C≦1%, then Rp=2, if concentration of solution 1%<C<10%, then Rp=4, if concentration of solution C≧10%, then Rp=6;

step 6) calculating a total heat flow (dQ/dt total) by equation 16, wherein if dQ/dt (total)>$Q_{of}$, then dQ/dt (total)=$Q_{of}$;

step 7) calculating a value for dm/dt by equation 17;

step 8) calculating a value for Ts(initial) by equation 13;

step 9) adjusting the shelf temperature to the Ts(initial) value calculated in stage III b, step 8 at a rate of about 0.5° C./min;

step 10) collecting MTM data every 15 min;

step 11) assigning an ice thickness: L'=L/0.918, where L is the liquid fill depth;

step 12) fitting the MTM data collected in stage III b, step 10 to equation 2 to yield Pice and Rp;

step 13) calculating a value for Tp MTM by equation 3, wherein if Tp MTM> Tp(initial), then decrease shelf temperature 5° C. at the maximum cooling rate, this new shelf temperature then becomes Ts(initial), the initial target product temperature, Tp(initial), is Tc−a safety margin, the safety margin is initially 3° C., the safety margin is re-calculated once the first MTM measurement is made and the target product temperature, Tp, is re-evaluated;

step 14) going to stage IV primary drying;

stage IV primary drying:

step 1) equilibrating the shelf temperature to within 2° C. of Ts initial for 60 min;

step 2) collecting MTM data every 30 min;

step 3) assigning an ice thickness as L'=L/0.918, where L is the liquid fill depth;

step 4) fitting MTM data to equation 2 to yield Pice and Rp;

step 5) calculating a value for Tp MTM by equation 3;

step 6) calculating a value for mass flow (dm/dt) by equation 4;

step 7) calculating a value for nominal heat flow $(dQ/dt)_{MTA-1}$ by equation 5, wherein if $(dQ/dt)_{MTA-1} \geqq Q_{of}$, then $(dQ/dt)_{MTA-1}=Q_{of}$, else $(dQ/dt)_{MTA-1}$ is the value calculated from equation 5;

step 8) calculating a value for product temperature $Tp_{overflow}$ by equation 15;

step 9) calculating a value for primary drying time, $t_{primary}$, by equation 6;

step 10) estimating a value for Tp(target) product temperature, wherein if $t_{primary}$<6 hr; use 5° C. safety margin (Tp(target) =Tc−5° C.), if $t_{primary}$>48 hr; use 2° C. safety margin (Tp(target) =Tc−2° C.), else use 3° C. safety margin (Tp(target)=Tc−3° C.), if Tp(target)>=$Tp_{overflow}$, then Tp(target)=$Tp_{overflow}$;

step 11) calculating a value for shelf temperature (Ts) using Method 1:

Method 1:

calculating temperature of bottom ice (Tb) by equation 10;

calculating heat transfer coefficient of vials (Kv) by equation 11;

calculating a value for the shelf temperature (Ts) by equation 7 and setting the shelf temperature to this calculated Ts value;

step 12) calculating a value for chamber pressure (Pc) by equation 1 using target product temperature as evaluated above using the safety margin selected based upon the primary drying time;

step 13) adjusting the chamber pressure to Pc calculated in stage IV, step 12;

step 14) collecting MTM data at time intervals;

step 15) fitting the MTM data to equation 2 to yield Pice and Rp;

step 16) calculating a value for Tp MTM by equation 3;

step 17) calculating a value for nominal heat flow by equation 5;

step 18) calculating a value for ice thickness using Method 2:

Method 2 calculating a value for mass flow by equation 4;

calculating a value for total weight of ice sublimed ($W_{sublimation}$) by equation 8;

calculating a value for ice thickness ($L_{ice}$) by equation 9;

step 19) calculating a value for the shelf temperature (Ts) using Method 1;

Method 1:

calculating the temperature of bottom ice (Tb) by equation 10;

calculating a value for the heat transfer coefficient of vials (Kv) by equation 11;

calculating a value for shelf temperature (Ts) by equation 7;

step 20) adjusting the shelf temperature to Ts calculated in stage IV, step 19 at a rate of about 1° C./min;

step 21) collecting MTM data every 15 minutes and fitting the MTM data to equation 2 to yield Pice and Rp;

step 22) calculating a value for Tp MTM by equation 3, wherein if Tp MTM>Tp(target)+1° C., than calculate Ts by equation 7 and adjust the shelf temperature to this calculated Ts (stage IV, step 22), else leave the shelf temperature at Ts calculated in stage IV, step 19;

step 23) going to stage IV, step 24 after the shelf temperature stabilizes at the Ts chosen in stage IV, step 22 for 1 hour or longer;

step 24) collecting MTM data every 60 min;

step 25) fitting the MTM data generated in stage IV, step 24 to equation 2 to yield Pice and Rp, wherein If Pice>P0+5 mTorr, go to Method 4, Method 4, calculating a value for Tp MTM by equation 3;

calculating a value for nominal heat flow by equation 5;

calculating a value for ice thickness by using Method 3,

Method 3, calculating a value for mass flow by equation 4, calculating a value for total weight of ice sublimation ($W_{sublimation}$) by equation 8, calculating a value for ice thickness ($L_{ice}$) by equation 9, wherein, if Lice>(⅓)*(L/0.918) and Tp<Tp(target)−1° C. or Tp>Tp(target)+1° C., then calculate Ts by Method 1 as described in Section IV, step 17, and adjust the shelf temperature to this value of Ts, (here, Tp means Tp MTM or product temperature evaluated experimentally by temperature sensors (i.e., thermocouples) placed directly in several vials, whichever method of temperature measurement is being employed; if $L_{ice}$≦(⅓)*(L/0.918) leave the shelf temperature at Ts previously calculated in stage IV, step 19; (note: if the ice remaining is so small as to meet this criterion, primary drying is almost over, and the shelf temperature is left where it was until primary drying is fully over);

If Pice≦P0+5 mTorr for one MTM measurements, go to stage IV, step 24; If Pice≦P0+5 mTorr for two successive MTM measurements, go to stage 5, secondary drying.

15. The method of claim 14 wherein stage 5, secondary drying comprises one of V a or V b:

V a For formulation with crystalline products and/or crystalline bulking agents:

step 1) adjusting the shelf temperature to about 40° C. at a rate of about 0.3° C./min;

step 2) holding the shelf temperature at about 40° C. for about 60 minutes;

step 3) adjusting the shelf temperature to about 50° C. at a rate of about 0.3° C./min;

step 4) maintaining the shelf temperature at about 50° C. for about 180 min; and step 5) adjusting the shelf temperature to 25° C. at a rate of about 2° C./min; or V a For non-crystalline formulations:

step 1) adjusting the shelf temperature to about 40° C. at a rate of about 0.1° C./min;

step 2) maintaining the shelf temperature at about 40° C. for about 240 min (if the concentration of formulation ≦5% w/w); or maintaining the shelf temperature at about 40° C. for about 360 min (if the concentration of formulation >5% w/w); and step 3) adjusting the shelf temperature to about 25° C. at a rate of about 2° C./min; or V b:

step 1) determining the residual moisture content of some of the product;

step 2) closing a valve separating the drying chamber from a condenser chamber and accumulating the pressure vs. time data;

step 3) calculating the weight percent residual moisture using equations 18, 19, and 20.

step 4) adjusting the shelf temperature to about 40° C. and holding the shelf temperature at 40° C. for about 60 minutes;

step 5) repeating steps 2–4 at hourly intervals until either: (a) the calculated residual moisture is less than or equal to the target residual moisture or (b) the total time elapsed since the beginning of this step exceeds 4 hours, if (a) is true, go to step 7 below; if (b) is true, go to step 6 below;

step 6) adjusting the shelf temperature to about 50° C.; holding the shelf temperature at about 50° C. for about 60 minutes, and repeating steps 1–4 at hourly intervals until either the calculated residual moisture is less than or equal to the target residual moisture or the total time elapsed in this step exceeds four hours, go to step 7; and step 7) adjusting the shelf temperature to about 25° C. at a rate of about 2° C./min.

16. The method of claim 14 comprising:

providing a controller having digital storage means; and saving parameters from the method, including optimized chamber pressure, target product temperature and shelf temperature vs. time profile to the digital storage means.

* * * * *

UNITED STATES PATENT AND TRADEMARK OFFICE

CERTIFICATE OF CORRECTION

PATENT NO. : 6,971,187 B1
APPLICATION NO. : 10/620931
DATED : December 6, 2005
INVENTOR(S) : Pikal et al.

It is certified that error appears in the above-identified patent and that said Letters Patent is hereby corrected as shown below:

Column 19:

Line 21, after "30" delete "mm;" and substitute --min;--.

Line 23, after "30" delete "mm;" and substitute --min;--.

Line 34, after "stage" delete "II" and substitute --III--.

Line 38, after "30" delete "mm;" and substitute --min;--.

Signed and Sealed this

Fifth Day of December, 2006

JON W. DUDAS
*Director of the United States Patent and Trademark Office*